United States Patent [19]

Murabito

[11] 4,024,664

[45] May 24, 1977

[54] SAFETY FOR RIFLE

[76] Inventor: Frank Murabito, 64-24 80th Ave., Glendale, N.Y. 11227

[22] Filed: Oct. 22, 1975

[21] Appl. No.: 624,794

[52] U.S. Cl. ..... 42/70 F

[51] Int. Cl.[2] ..... F41C 17/04

[58] Field of Search ..... 42/70 F, 70 R

[56] References Cited

UNITED STATES PATENTS

| | | | |
|---|---|---|---|
| 547,454 | 10/1895 | Schmeisser | 42/70 F |
| 712,282 | 10/1902 | Fay et al. | 42/70 F |
| 845,994 | 3/1907 | Beckwith | 42/70 F |

*Primary Examiner*—Charles T. Jordan
*Attorney, Agent, or Firm*—Allison C. Collard

[57] ABSTRACT

A safety device particularly suitable for rifles and carbines consisting of a rod connected to a lever which can be inserted through a bore in the back side of the rifle hammer when the hammer is extended slightly past the fully cocked position. The rod can engage the hammer and prevent the hammer from moving regardless of the motion of the trigger.

6 Claims, 4 Drawing Figures

SAFETY FOR RIFLE

This invention relates to an improved safety for use on a rifle.

More specifically, this invention relates to a safety which engages the hammer of a rifle for preventing accidental misfiring.

In rifles, such as lever action carbines, there has been found to be no effective safety for preventing an accidental misfire. In most conventional lever action carbines or rifles, the safety consists of pulling the hammer back to an intermediate position which locks the lever action from further movement. However, with the hammer slightly cocked into its "safety position", the rifle has been known to discharge accidentally if it is dropped or jarred. Many thousands of persons are seriously injured or killed each year from the accidental discharge of rifles due to defective safety mechanisms.

Accordingly, the present invention provides an improved and silent safety device which can be easily installed on most existing rifles and adapted for the manufacture of new rifles which prevents the accidental discharge of the rifle. The improvement consists of a lever and pin mechanism which engages the trigger of the rifle in at least one position so as to restrain the trigger from movement until the safety latch is released. With the safety device of the present invention, it has been found that the rifle can be dropped or severely jarred without accidentally discharging.

It is therefore an object according to the present invention to provide an improved safety for a rifle or carbine.

It is another object according to the present invention to provide an improved safety which engages the trigger of the rifle to prevent accidental discharge;

It is stll a further object according to the present invention to provide an improved safety which is simple in design, inexpensive in cost, and reliable in operation.

Other objects and features of the present invention will become apparent from the following detailed discription considered in connection with the accompanying drawing which discloses the embodiment of the invention. It is to be understood however that the drawing is designed for the purpose of illustration only and not as a definition of the limits of the invention.

In the drawing wherein similar reference characters denote similar elements throughout the several views.

Figure 1:
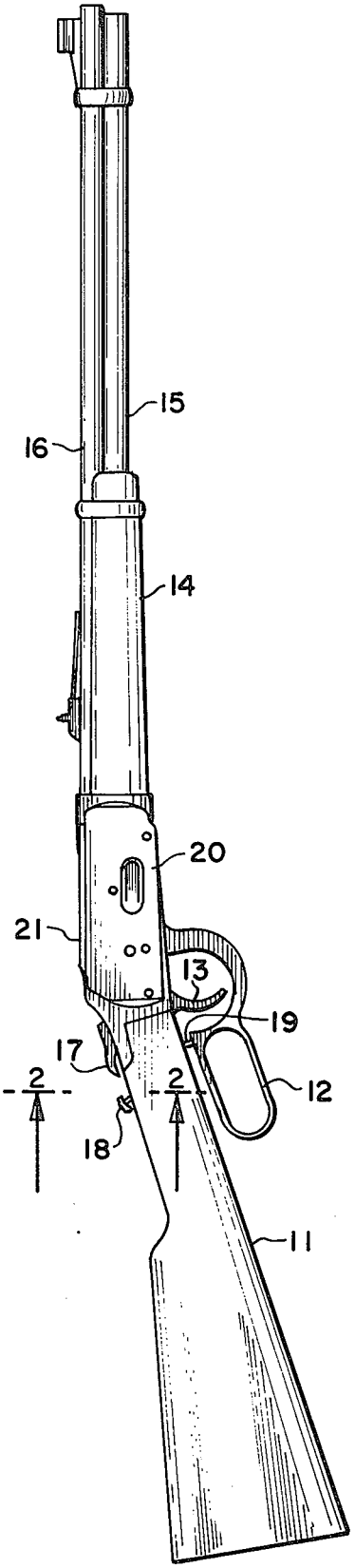
FIG. 1 is a plan view of a rifle having the improved safety device according to the invention.
Figure 2:
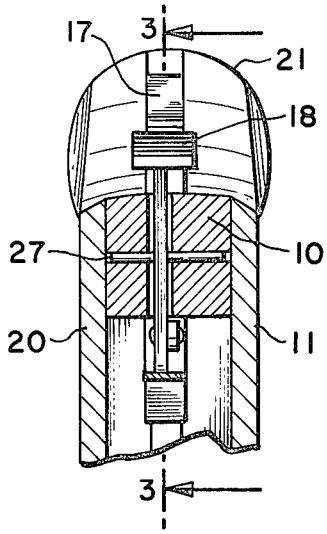
FIG. 2 is a cross sectional view taken through section 2—2 of FIG. 1.

Referring to FIGS. 1–4 there is shown a rifle having a stock 11 onto which is mounted a receiver 20 for pivotably securing a trigger 13 and a hammer 17. Mounted to the receiver is a barrel 16 and a magazine tube 15 fitted through a carbine forearm piece 14. A breech bolt is slidably mounted within receiver 20 and is engaged to a hand lever 12, so that cartridge shells may be loaded into or ejected from the firing chamber of the rifle while cocking hammer 17 simultaneously.

Below stock 11, adjacent to the fully closed position of lever 12, is a pin 19 which engages the edge of the lever. In the design of most rifles this pin prevents the trigger from being operated until a lever is fully closed in order to assure that the breech bolt is closed against the cartridge in the chamber. Hammer 17 is pivoted by means of pivot pin 31 in receiver 20 as shown in detail in FIGS. 3 and 4. As is well known in the art, a leaf spring 28 urges the hammer into its closed position against the back of the breech bolt which contains the firing pin. The hammer includes a pair of notches which engage the end of a trigger 13. In the position shown in FIG. 4, when the trigger is pulled so as to rotate clockwise, it will become disengaged from the notch and allow the hammer to spring forward and strike the firing pin. The second notch provided in the hammer causes the hammer to be locked to the trigger so that the trigger becomes inoperable providing a safety position for the hammer. In many instances, however, when the rifle is dropped, the hammer moves and releases the trigger from this forward notch causing an accidental discharge of the rifle. In the present invention, the tigger is provided with at least one bore 29 along its rear surface for receiving and engaging a rod 24 which is pivotably mounted adjacent to the end of a lever 32. Lever 32 is pivotably mounted in the tail portion 10 of receiver 20 in an hour-glass type opening 26. The opposite end of lever 32 contains a knurled thumbpiece 18 in order to allow the user to engage and disengage rod 24 into opening 29 of the hammer.

The end of lever 32 adjacent to pivot 25 engages a spring 22 which has a convex U-shaped detent. Spring 22 is mounted by means of a screw 23 to tailpiece 10 of receiver 20. Tailpiece 10 has also been modified to include a cone-shaped bore 33 in order to accommodate rod 24 which engages the back end of the hammer.

Figure 3:
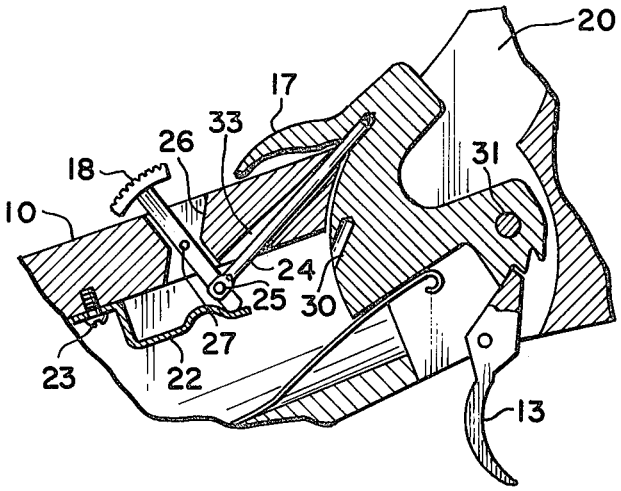
FIG. 3 is a cross sectional view taken along section 3—3 of FIG. 2.

In operation, the hammer of the rifle is pulled to its fully opened position beyond its fully cocked firing position and thumbpiece 18 is pivoted by the tumb of the user to its rear positon as shown in FIG. 3 so that rod 24 can move into bore 29 to engage the trigger. Spring 28 tends to urge trigger 13 forward but rod 24 prevents hammer 17 from being moved forward even if trigger 13 is depressed.

Figure 4:
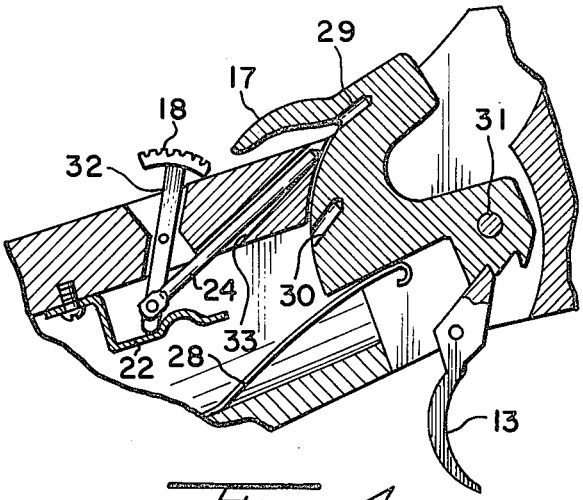
FIG. 4 is a further cross sectional view similar to that of FIG. 3 showing a different position of the safety device of the present invention.

When the safety is to be released, thumbpiece 18 is pushed forward toward the back of hammer 17 so that rod 24 is withdrawn from bore 29. As shown in FIG. 4, hammer 17 will then rotate a small angular distance clockwise around pivot 31 so that its notched portion fully engages trigger 13 and thus sets the rifle up in its firing position. In moving thumbpiece 18 to its forward position, the end of lever 32 rides over the convex detent of spring 22 to assume a position at the other side and thus rod 24 is maintained in its retracted position.

Hammer 17 may also be provided with a second bore 30 for receiving rod 24 when the hammer is in a almost closed position such as when trigger 13 is engaged into the forward notch of the hammer as described with respect to built in safety position of the rifle.

One of the advantages of the safety device of the present invention is that it can be released without any noise or click so that the rifle becomes immediately operable, a feature which has a distinct advantage for hunters.

While only a single embodiment of the present invention has been shown and described it will be obvious that many changes and modifications may be made thereunto without departing from the spirit and scope of the invention.

What is claimed is:

1. In a rifle having a receiver portion for pivotably mounting a hammer which engages a trigger the improvement comprising a safety which engages said hammer, said safety including at least one bore formed in the rear surface of the hammer, lever means engaging said bore in at least one pivoted position of said hammer, said lever means additionally comprising a lever pivotably mounted adjacent to said hammer, a rod connected adjacent to the end of said lever for movement toward and away from said trigger, said rod engaging said at least one bore formed in said hammer, and a spring engaging said lever means urging said lever means into engagement with said at least one bore.

2. The rifle as recited in claim 1 said spring engaging the end of said lever adjacent to its connection with said rod for defining the engaged and disengaged position of said rod with respect to the hammer.

3. The rifle as recited in claim 2 wherein said spring includes a U-shaped convex detent engaging the end of said lever.

4. The rifle as recited in claim 3 wherein the exposed end of said lever includes a thumbpiece.

5. The rifle as recited in claim 4 wherein said at least one bore is positioned on said hammer to maintain the hammer disengaged from said trigger.

6. The rifle as recited in claim 5 additionally comprising a second bore formed in the rear surface of said hammer, said second bore adapted to receive said rod in order to maintain said hammer in a fixed position that is substantially closed with respect to the hammer position corresponding to said first bore.

* * * * *